US007159531B2

(12) United States Patent
Baylor

(10) Patent No.: US 7,159,531 B2
(45) Date of Patent: Jan. 9, 2007

(54) BOAT SYSTEM

(75) Inventor: Wesley Terran Baylor, Garden Grove, CA (US)

(73) Assignee: Lear Baylor, Inc., Garden Grove, CA (US)

( * ) Notice: Subject to any disclaimer, the term of this patent is extended or adjusted under 35 U.S.C. 154(b) by 17 days.

(21) Appl. No.: 11/109,522

(22) Filed: Apr. 19, 2005

(65) Prior Publication Data

US 2006/0231010 A1 Oct. 19, 2006

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 2,041,281 A * 5/1936 Bishop ..... 296/224
3,371,672 A 3/1968 Hale et al.
D221,809 S 9/1971 Love
3,823,431 A 7/1974 Miller
D312,239 S 11/1990 Down
5,044,298 A 9/1991 Pepper et al.
5,058,946 A * 10/1991 Faber ..... 296/186.4
5,622,136 A 4/1997 Zirkelbach et al.
D407,366 S 3/1999 Badsey
6,209,477 B1 4/2001 Biedenweg
6,860,222 B1 * 3/2005 Himmel ..... 114/361
2003/0217683 A1 * 11/2003 Heckman ..... 114/361

* cited by examiner

*Primary Examiner*—Sherman Basinger
(74) *Attorney, Agent, or Firm*—Walter A. Hackler

(57) ABSTRACT

A boat includes a hull, topsides with a cockpit therein. A top is provided having a perimeter contoured for engaging a topsides perimeter in a closed position and providing a canopy for the topsides in an open position. Linear actuators are provided for moving the top between the open and closed positions along with a motor mechanism for operating the linear actuation. A panel moveably attached to the top enables operator entry and exit from the boat with the top in the closed position through an access provided by the panel.

6 Claims, 3 Drawing Sheets

BOAT SYSTEM

The present invention is generally directed a boat and bonnet therefore and is more particularly directed to a boat with a rigid bonnets, or canopy, which enables boat closure upon lowering of the bonnet and a canopy with the bonnet in a raised position while at the same time enabling operator entry, exit, and operation of the boat with the bonnet in a closed position.

A great number of types of tops for boats have been designed and constructed. Boat canopies, or tops, which are rigid in nature have not proved practical heretofore due to the inherent lack of storage area for such canopies aboard the boat, as well as the inconvenience and difficulty of installing and moving and storing the canopy, or top.

On the other hand, convertible soft type canopies have been utilized which may be either removable from the boat or folded in storage on the boat. However, such tops do not provide a secure vessel with regard to both the environment and vandalism.

Even though the convertible top may be folded, it still occupies a considerable amount of space aboard the boat topsides and, of course, in a folded state provides no benefit to the boat operator.

U.S. Pat. No. D407366 discloses a boat with a bonnet or a canopy which is movable from a closed position sealing the topsides of the boat to an open position in which the canopy is elevated and provides a shaded environment for the boat operator. Unfortunately, this design does not enable or provide for an operator to conveniently operate the boat when the canopy is in a closed position for either foul weather or convenience.

The present invention provides for a boat and a bonnet which provides for both a shade providing canopy when in an open position and a secure vessel when in a closed position while at the same time enabling access to and from the vessel, or boat, when the bonnet is in a closed position, and facilitating operation of the boat with the bonnet in a closed position.

SUMMARY OF THE INVENTION

A boat in accordance with the present invention generally includes a hull along with topsides with a cockpit therein. A top is provided having a perimeter contoured for engaging a topside perimeter of the hull in a closed position and providing a canopy for the topsides in an open position.

Linear actuators are provided for moving the top between the open and closed position along with a motor mechanism for operating the actuators.

Specifically, in accordance with the present invention, a panel is provided and movably attached to the top for enabling operator entry and exit from the boat with the top in a closed position through an access provided by the panel.

In addition, the motor mechanism preferably includes a plurality of motors with each motor being disposed in an operative relationship within a corresponding linear actuator.

In order to provide a safety feature and prevent injury or damage during closure of the top against the topsides, each actuator is attached to the hull with a compliant fixture for reducing pressure on any object disposed between the hull and the top during movement of the top to the closed position. More specifically, the compliant fixture includes a slotted bracket and each of the actuators includes a cross bar slidably retained in a corresponding slot.

A control system is provided for driving the motors and actuators in a manner which prevents torquing of the top. In that regard, the control system utilizes circuitry for monitoring the electrical current drawn by each of the motors and is responsive to unequal current draw for stopping operation in order to prevent unwanted torquing of the top which may cause damage thereto.

The present invention is also directed to the bonnet which may be utilized with a boat having a hull topsides and cockpit with the bonnet including a movable top having a perimeter contoured for engaging a boat topsides for sealing the cockpit in a closed position and providing a canopy for the topsides in an open position.

An actuator system is provided for moving the top between the open and closed position within a panel is movably attached to the top before enabling operator entry and exit from the boat with the top in a closed position through an access provided by the panel.

BRIEF DESCRIPTION OF THE DRAWINGS

The present invention may be more clearly understood with reference to the following detailed description in conjunction with the appended drawings, of which.

DETAILED DESCRIPTION

Figure 1:
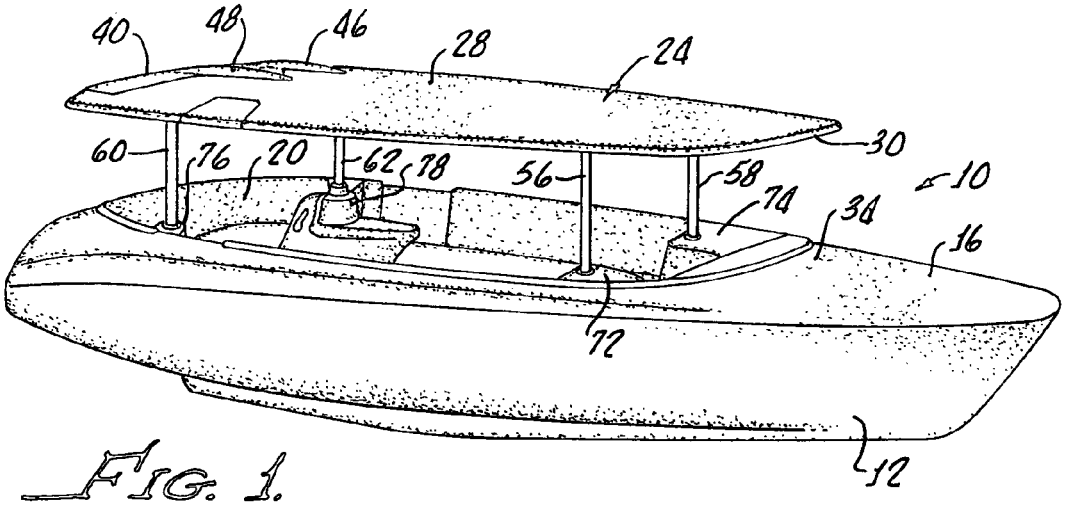
FIG. 1 is a perspective view of a boat and bonnet in accordance with the present invention generally showing a hull, topsides, a top, and a cockpit area with the top being illustrated in an open position.
Figure 2:
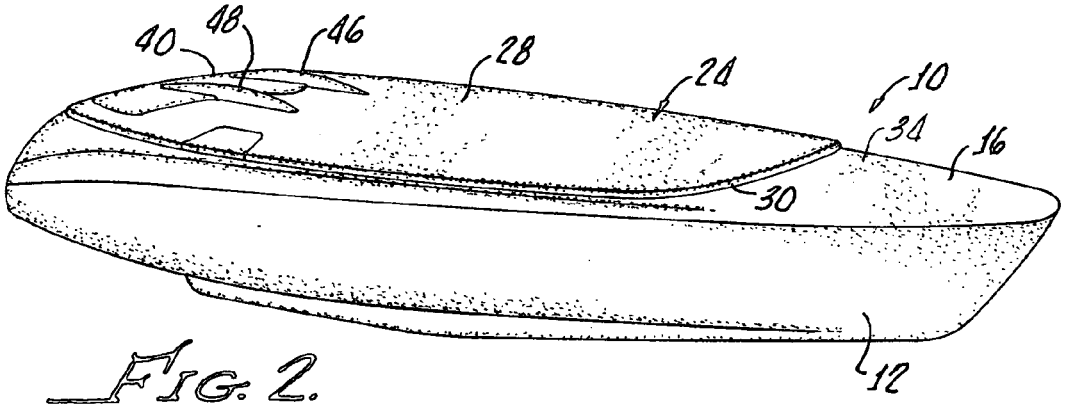
FIG. 2 is a view similar to FIG. 1 with the top in a closed position sealing the cockpit.
Figure 3:
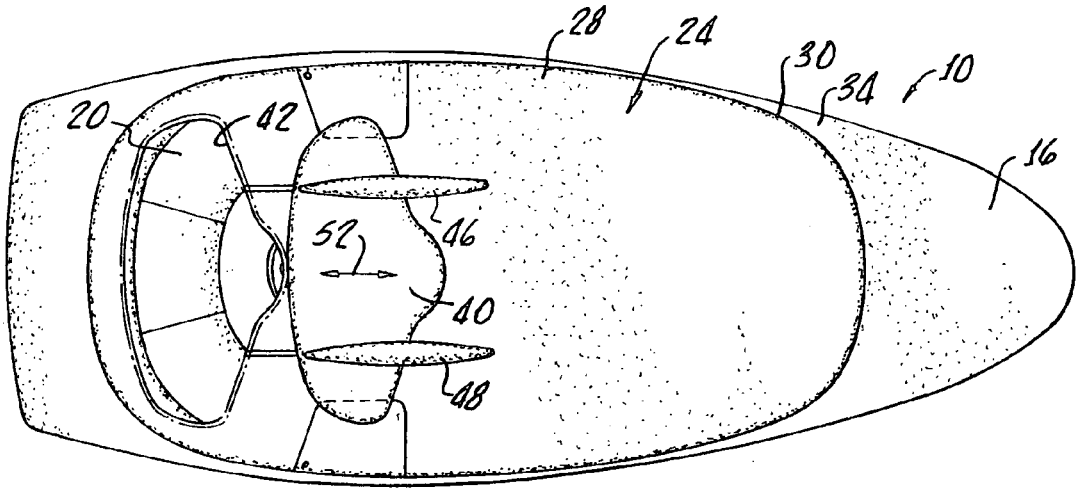
FIG. 3 is a top view of the boat and bonnet shown in FIGS. 1 and 2, more particularly showing a panel movably attached to the top for enabling operator entry and exit from the boat with the top in a closed position through an access provided by the panel, as shown in FIG. 3.

With reference to FIGS. 1–3, there is shown a boat 10 in accordance with the present invention generally including a hull 12 and topsides 16 with a cockpit area 20 therein. A bonnet 24 is provided which includes a top 28 having a perimeter 30 for engaging a topsides perimeter 34 in a closed position, as shown in FIGS. 2 and 3, and providing a shade canopy for the topsides 16, particularly the cockpit 20 when in an open position as shown in FIG. 1.

It should be appreciated that all of the components of the boat 10 and bonnet 24 may be constructed from common marine materials such as, for example, fiberglass, or the like.

A panel 40 is movably attached to the top 28 for enabling operator (not shown) entry and exit from the boat with the top 28 in a closed position, as shown in FIG. 3, by an access 42 through the top 28 provided by the panel 40 in the open position, as shown in FIG. 3.

The panel 40 may be attached to the top 28 as hereinafter discussed and may utilized slides 46, 48 enabling movement as indicated by the arrow 52 between a closed position shown in FIG. 2 and an open position shown in FIG. 3.

Figures 4, 5, 6:
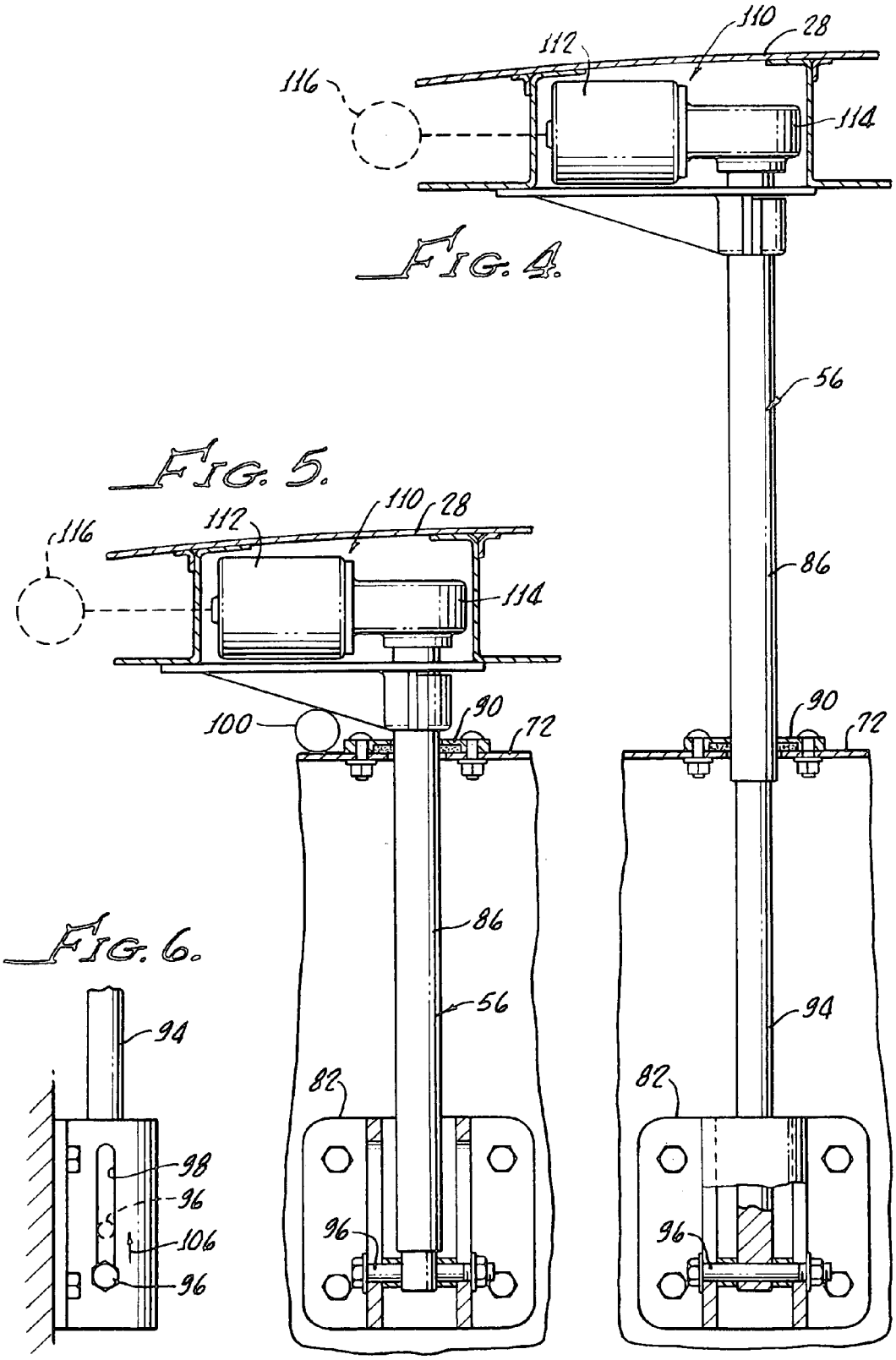
FIG. 4 is an enlarged view of actuators for moving the top between the open and closed positions along with a motor mechanism for operating the actuators, the actuators being extended with the top shown in an open position.
FIG. 5 is a view similar to that shown in FIG. 4 with the actuators in a retracted position and the top in a closed position.
FIG. 6 is a side view of a compliant fixture for reducing pressure on an object which may be inadvertently placed between the hull and the top during closure of the top which includes a slot, as shown in conjunction with a cross bar member illustrated in FIGS. 4 and 5.

With references to FIGS. 1, 4, and 5, linear actuators 56, 58, 60, 62 are provided for moving the top 28 between the open and closed positions. Interconnection between the top 28 and inboard portions 72, 74, 76, 78, is best shown in FIGS. 4 and 5. The linear actuators 56, 58, 60, 62 may be of a conventional type and are affixed to the hull 12 through the use of compliant fixtures 82, only one being shown for clarity.

Stabilization of upper portions 86 of the actuator 56 is provided by bushings 90 fitted to the inboard portions 72 while a lower portion 94 of the actuator 56 is attached via a cross bar 96 in a slot 98 in the fixture 82, as best shown in FIG. 6.

This arrangement provides a safety feature by reducing pressure on an object 100, shown in dashed line in FIG. 5, upon lowering of the top 28, as indicated by the arrow 102 in FIG. 5. Such an object 100, which may be, for example, a piece of equipment or operator's limb causes the actuator 56 to lift in the slot 98, as indicated by the arrow 106 and cross bar 96, as indicated in dash line. Thus, the fixture 82 provides for compliance to reduce any damage or harm to the top 28 or object 100.

The linear actuator 56, 58, 60, 62 are operated by a motor mechanism 110 disposed in a conventional operative relationship therewith utilizing a motor 112 and gear box 114.

It should be appreciated that a motor mechanism 110 is provided for each actuator 56, 58, 60, 62 within the top 28, only one being shown for clarity, all other motor mechanisms being identical.

A control system 116 shown in dash line in FIGS. 4 and 5 is provided for driving the motors 112 and actuator 56 in a manner preventing torquing of the top 28. Such torquing may occur if the motors do not drive the actuators 56, 58, 60, 62 in a coordinated manner. That is, if one of the actuators 56, 58, 60, 62 operates faster than another, twisting the top may occur. This is accomplished by including conventional circuitry in the controller 116 for monitoring the current drawn by each of the motors in operation thereby insuring coordinated movement of the actuators 56, 58, 60, 62 in both raising and lowering the top 28.

Figure 7:
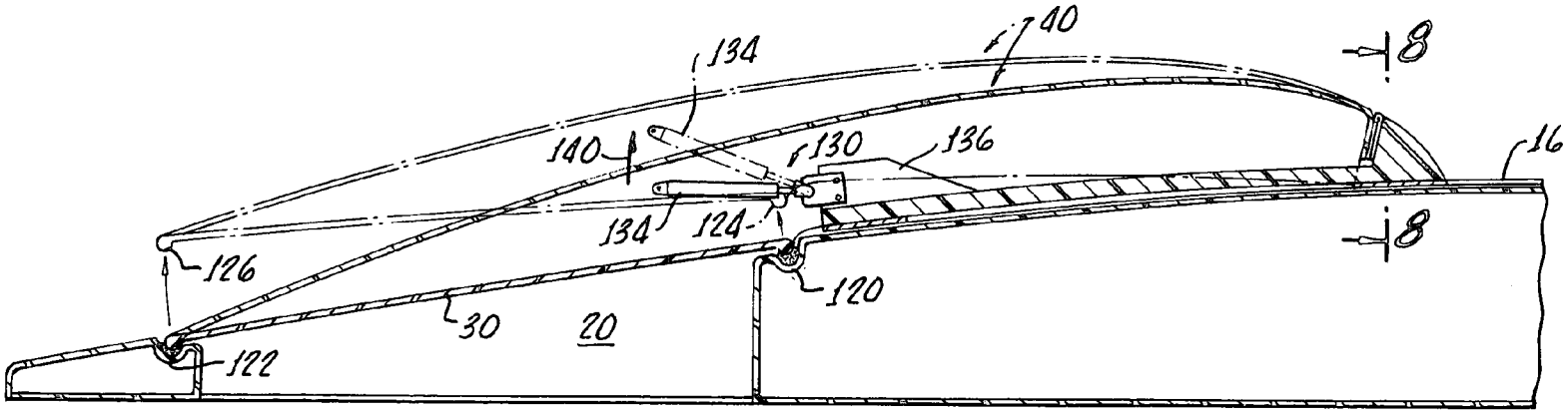
FIG. 7 is a cross sectional view of the panel showing seals for closing the cockpit and a lift mechanism for releasing a panel for sliding to an open position.

With reference to FIG. 7, showing a cross section of the panel 40, a seal is provided around the cockpit 20 by grooves 120, 122 formed in the topside 16 sized for receiving ridges 124, 126 in an underside 130 of the panel 40.

Figure 8:
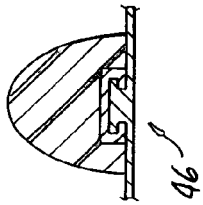
FIG. 8 is a cross sectional view taken along the line 8—8 of FIG. 7 illustrating a slide for the cover.

In order to enable the panel 40 to be moved forward along the slides 46, 48, see also FIG. 8, a lift mechanism 132 is provided which includes a lever 134 pivotally attached to a bracket 136.

Figure 9:
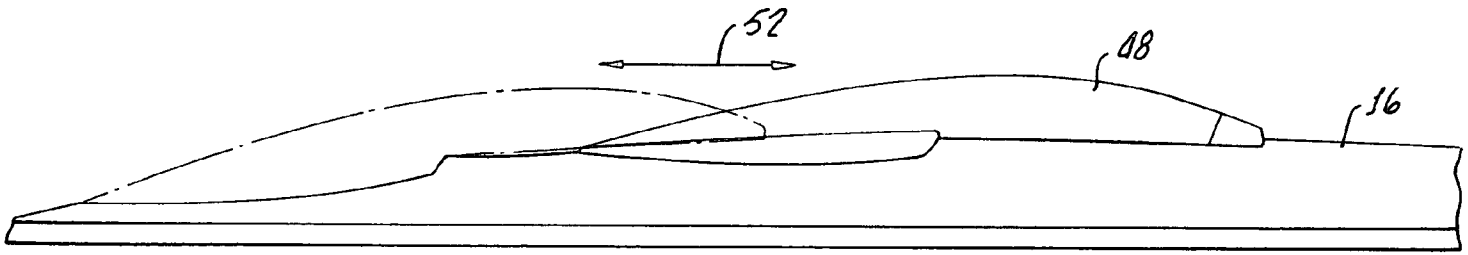
FIG. 9 is a diagram showing an open position exposing the cockpit and a closed position (dashed line) sealing the cockpit.

In operation, the lever is moved upward, as indicated by the arrow 140 thereby disengaging the ridges 124, 126 from the grooves 120, 122, as indicated in phantom line in FIG. 7. Thereafter, the panel 40 may be slit forward along the slides 46, 48, as indicated by the arrow 52 in FIGS. 3 and 9.

Although there has been hereinabove described a specific boat system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A boat comprising:

a hull;

topsides with a cockpit therein;

a top having a perimeter contoured for engaging a topsides perimeter in a closed position and providing a canopy for the topsides in an open position, said top sealing said topsides in the closed position;

linear actuators for moving the top between the open and closed positions, each actuator is attached to the hull with a compliant fixture for reducing pressure on an object placed between said hull and top upon contact therewith during movement of said top to the closed position;

a plurality of motors for operating said linear actuators each motor being disposed in an operative relationship with a corresponding actuator; and a panel moveably attached to the top for enabling operator entry and exit from said boat with the top in said closed position through an access provided by said panel.

2. The boat according to claim 1 wherein each compliant fixture includes a slotted bracket and each actuator includes a cross bar slidably retained in a corresponding slot.

3. The boat according to claim 2 further comprising a control system for driving said motors and actuators in a manner preventing torquing of said top.

4. A bonnet for a boat having a hull, topsides and cockpit, said bonnet comprising:

a moveable top having a perimeter contoured for engaging a topsides for sealing said cockpit in a closed position and providing a canopy for the topsides in an open position;

an actuator mechanism for moving the top between the open and closed positions, said actuator mechanism including a plurality of linear actuators interconnected between the hull and the top, each actuator being attached to the hull with a compliant fixture for reducing pressure on a object placed between said hull and top upon contact therewith during movement of said top to the closed position, said actuator mechanism including a plurality of motors disposed in said top, each motor being disposed in an operative relationship with a corresponding linear actuator; and a panel moveably attached to the top for enabling operator entry and exit from said boat with the top in said closed position through an access provided by said panel, the access enabling operation of said boat by the operator situated in the boat cockpit with visual recognition over the top through the access.

5. The bonnet according to claim 4 wherein each compliant fixture includes a slotted bracket and each actuator includes a cross bar slidably retained in a corresponding slot.

6. The bonnet according to claim 5 further comprising a control system for driving said motors and actuators in a manner preventing torquing of said top.

* * * * *